US007214096B2

(12) United States Patent
Huang et al.

(10) Patent No.: US 7,214,096 B2
(45) Date of Patent: May 8, 2007

(54) MINI-USB RECEPTACLE CONNECTOR

(75) Inventors: Shang-Yen Huang, Taipei (TW); Sheng-Ho Yang, Taipei (TW)

(73) Assignee: Advanced Connectek Inc., Taipei (TW)

( * ) Notice: Subject to any disclaimer, the term of this patent is extended or adjusted under 35 U.S.C. 154(b) by 0 days.

(21) Appl. No.: 11/212,061

(22) Filed: Aug. 26, 2005

(65) Prior Publication Data

US 2006/0234550 A1 Oct. 19, 2006

(51) Int. Cl.
*H01R 13/648* (2006.01)

(52) U.S. Cl. ..... 439/607

(58) Field of Classification Search ..... 439/607, 439/608, 609, 79
See application file for complete search history.

(56) References Cited

U.S. PATENT DOCUMENTS 5,938,473 A * 8/1999 Nishio et al. ..... 439/567
5,984,725 A * 11/1999 Belopolsky et al. ..... 439/607
5,993,258 A * 11/1999 Matsunuma et al. ..... 439/607
6,371,809 B1 * 4/2002 Chun-Yuan ..... 439/607
2002/0086581 A1 * 7/2002 Chen et al. ..... 439/607
2003/0157836 A1 * 8/2003 Morikawa et al. ..... 439/607
2003/0228800 A1 * 12/2003 Suzuki et al. ..... 439/607

* cited by examiner

*Primary Examiner*—Tulsidas C. Patel
*Assistant Examiner*—Vladimir Imas
(74) *Attorney, Agent, or Firm*—Troxell Law Office, PLLC

(57) ABSTRACT

The present invention provides a shielding shell structure for an electrical connector. The shielding shell encloses the terminal seat formed by a housing and terminals to constitute the electrical connector. The shielding shell has flanges on its bottom, which could engage with the circuit board so as to intensify the shielding shell and to prevent the shielding shell of the electrical connector from deforming for the outer force during plug/unplug process.

3 Claims, 2 Drawing Sheets

MINI-USB RECEPTACLE CONNECTOR

BACKGROUND OF THE INVENTION

1. Field of the Invention

The present invention relates to a shielding shell structure for an electrical connector, more particularly to a shielding shell structure for an electrical connector having flanges, which could engage with the circuit board to prevent the shielding shell from deforming for the outer force during plug/unplug process.

2. Description of Related Art

With the advancement of technology, digital products are filled in our daily life gradually, but digital products with large volume are not convenient to the users. Therefore, because of the advancement of technology, more and more digital products make reduction in size to provide more light service to the users. Consequentially, the electrical connectors connecting the digital product and its peripheral device are also miniaturized in size constantly with the development of digital products; the applying range of the Mini-USB receptacle connector is wider and wider. For its high using value and large demand quantities, there are still issues of how to enlarge its applying range and how to heighten its using effect in creating or manufacturing the product. And there are still issues of how to achieve a convenient and stable plug/unplug applying effect. These issues are always the problems to be solved when manufacturers enlarge the product markets and are also objects when manufacturers seek for being to heighten competitive ability.

The existing Mini-USB receptacle connector usually comprises a housing, a terminal seat and a shielding shell enclosing around the housing. For the volume of the Mini-USB connector is small, the range enclosed by the shielding shell is consequentially small, relatively the engaging portion thereof is inevitably small, but the received plug/unplug force doesn't reduce with the reduction of the connector volume. Therefore its durability is tested considerably and the engaging portion of the shielding shell also confronts with an embarrassment of less engaging force. A general convention Mini-USB connector as shown in FIG. 1, although there are fastening leg structures on the peripheral, the matching insertion hole area still doesn't get appropriate reliable structure support. After times of plug/unplug, the insertion portion of the shielding shell may deform and shorten the using life of the product if there is no stable structure.

As the mentioned above, the Mini USB receptacle connector is used extensively and frequently, therefore, to strengthen the engaging force of the shielding shell life of the product when the connector volume is reduced is particularly needed.

SUMMARY OF THE INVENTION

The main object of the present invention is to provide a shielding shell structure for an electrical connector, which has bent flanges on the engaging portion of the shielding shell by engaging the flanges with the circuit board to prevent the shielding shell of the connector from deforming as the outer force applied during plug/unplug process.

To achieve the above object, the shielding shell for an electrical connector in the present invention comprises at least one first flange and at least one second flange. The first flange is located on the lower edge of the first engaging piece of the shielding shell, and the second flange is located on the lower edge of the second engaging piece of the shielding shell. The first and second flanges form a flange portion when the first and second engaging pieces interlock with each other to form a bottom engaging portion, and the flange portion bends downward and engages with the circuit board by soldering.

In order to have the structure and technical features of the present invention become more apparent to those skilled in the arts, detailed descriptions taken with accompanying drawings are given hereafter.

DETAILED DESCRIPTION OF THE PREFERRED EMBODIMENTS

Figure 1:
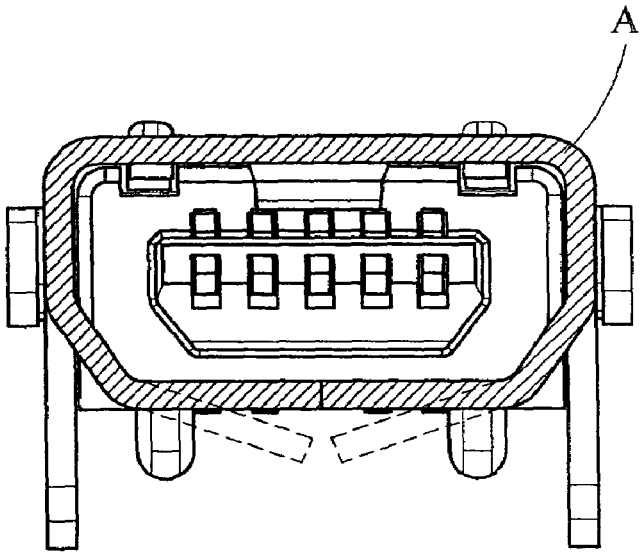
FIG. 1 is a section view of the shielding shell of the known electrical connector.
Figure 2:
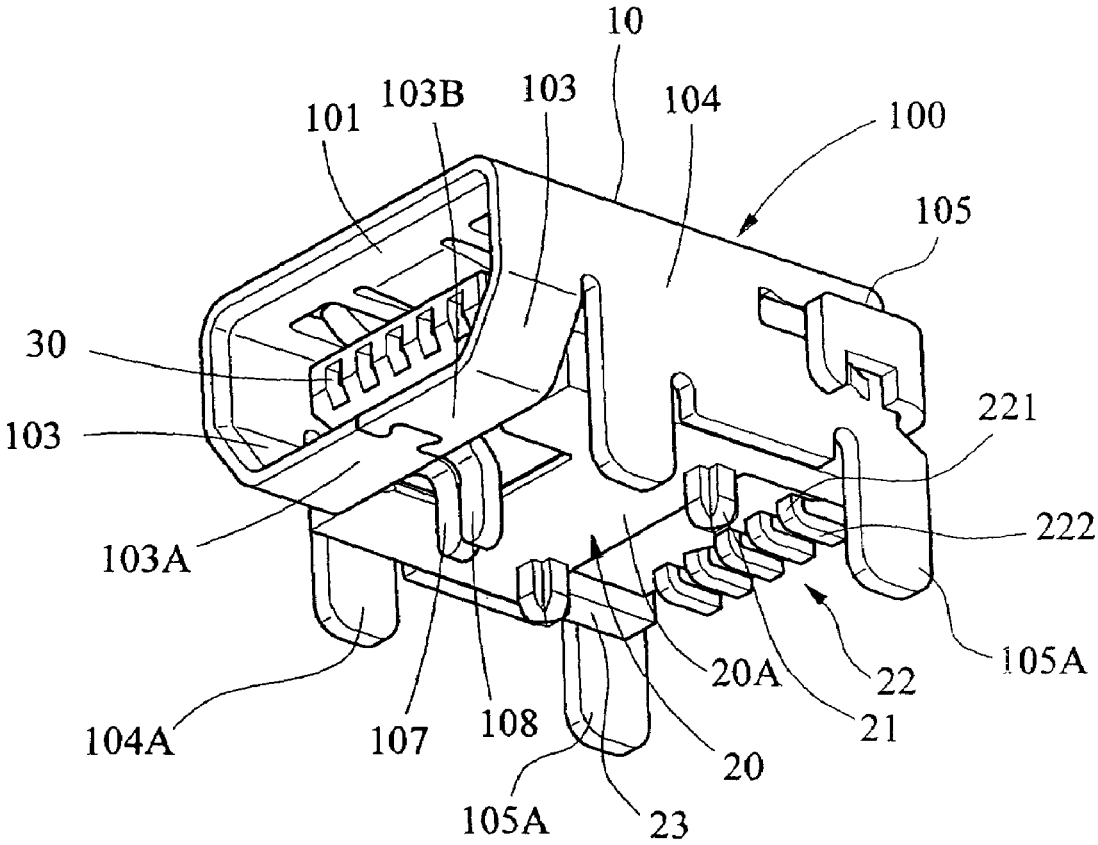
FIG. 2 is a perspective view of the preferred embodiment of the present invention.

Referring to FIG. 2, there is a perspective view of the preferred embodiment of the present invention. The present embodiment is a Mini-USB receptacle connector. In the present invention the electrical connector 100 has a shielding shell 10 enclosing the terminal seat 20 constituted by a housing 20A and terminals 22. It has an insertion hole 30 for the mating connector to insert thereinto, so as to achieve electrical connecting effect. In the present embodiment, the connector 100 could be mounted onto the circuit board of the SMT (surface mounting technology) type as an input/output port with the mating connector. The Mini-USB receptacle connector is a conventional structure and the basic structure of the connector in the present invention is similar to the conventional one. Therefore the relevant portions are not described any more.

As shown in FIG. 2, the housing 20A is enclosing the terminals 22 therein, and has two downward extending legs 21 to insert into a hole on the circuit board of the Surface Mounting Technology (SMT) type and at least one side block 23 disposed on an either side of the legs 21 in which the thickness of the block 23 is substantial same as that of the terminals 22 so that the bottom position of the block 23 is substantial flush with that of the terminals 22. The terminals 22 expose from the rear bottom of the housing 20A each including a vertical portion 221 extending from the rear bottom of the housing 20A and a horizontal portion 222 bending from the vertical portion 221.

The shielding shell 10 is provided with an upper plane piece 101, and two front side plane pieces 103, two middle side plane pieces 104, two rear side plane piece 105, two projecting members 104A and 105A downward extending from the lower edge of each side plane pieces 104 and 105 so as to enable the bottom portion of the terminal seat 20 to expose to the bottom of the shielding shell 10, a first engaging piece 103A and a second engaging piece 103B on the edge of each side plane pieces 103 respectively. On the lower edge of the first engaging piece 105 extending a bent first flange 107, and on the lower edge of the second engaging piece 103B extending a bent second flange 108. The first engaging piece 103A and the second engaging piece 103B could be interlocked with each other by dovetail grooves to form a front bottom engaging portion and along with the upper plane piece 101 as well as the two side plane pieces 103 to define a space for the insertion hole 30.

After the first engaging piece 103A and the second engaging piece 103B are interlocked with each other to form an engaging portion, the first flange 107 and the second flange 108 are juxtaposed to form a flange portion. When the connector is mounted onto the circuit board of the SMT type, the flange portion can be inserted into the predetermined hole on the circuit board of the SMT type, with the leg 21 of the housing 20A and two pairs of downward extending projecting members 104A 105A inserted into the respective holes in the SMT circuit board. As a result, the bottom of the horizontal portion 222 of each terminals 22 will be well connected to the respective contacts in the SMT type circuit board and can achieve an excellent electrical connection by soldering. It results in the insertion hole 30 on the front part of the connector being well supported, as well. As a result, the receptacle can endure repeating plug/unplug actions from the mating connector.

Figure 3:
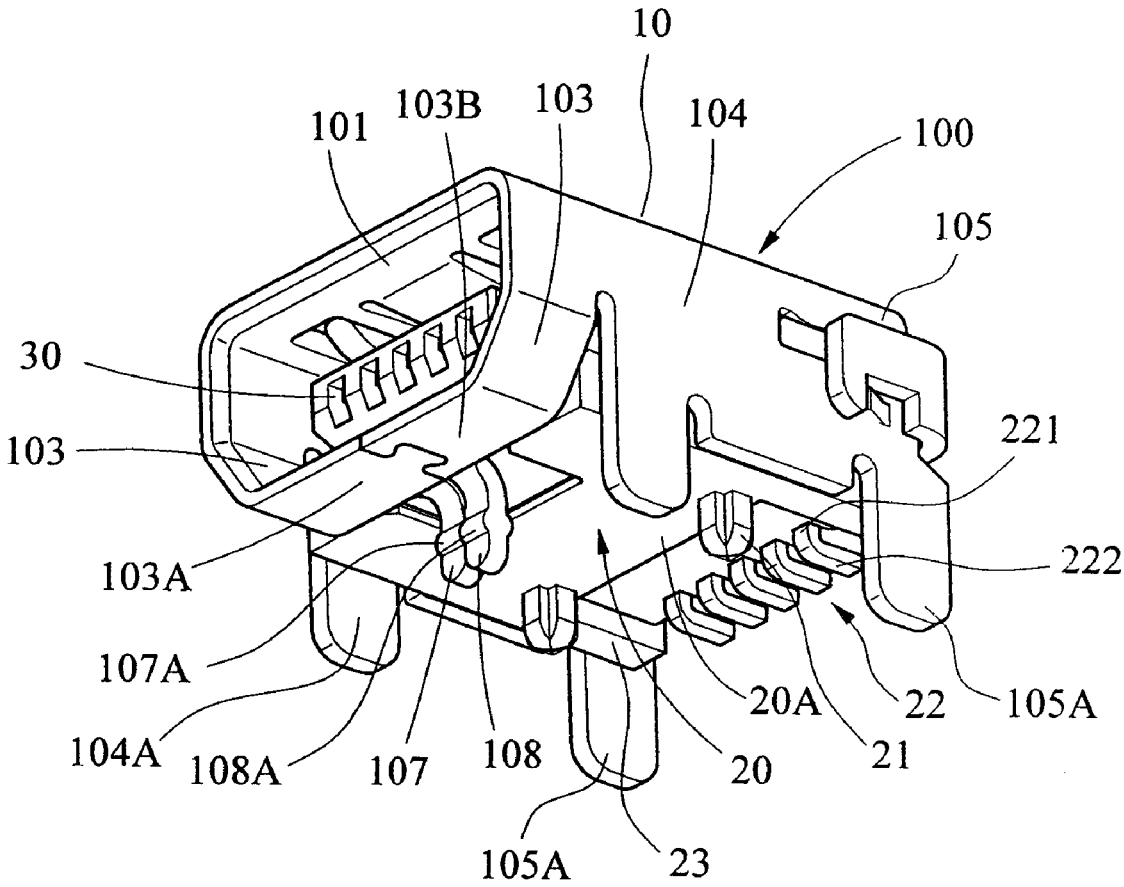
FIG. 3 is a perspective view of another preferred embodiment of the present invention.

The present invention still has other various embodiments. As shown in FIG. 3, it is a perspective view of another preferred embodiment of the present invention. In the present embodiment, on the appropriate position of the first flange 107 and the second flange 108 respectively having a protrusion 107A–108A which can clasp the hole on the circuit board so that the connector does not detach from the circuit board when the connector is mounted on the circuit board. Therefore the soldering process is reduced but it still achieves the structure of stabilizing the insertion hole space.

The structures of the embodiments disclosed in the present invention are illustrative only and not limitative to the scope of the present invention. Any changes or modifications made by those skilled in the art via the description of the present invention without departing from spirits of the invention are considered as like structures of the invention and covered by the claims of the present invention.

What is claimed is:

1. An electrical connector having a shielding shell and a terminal seat, the terminal seat comprising a housing and terminals, the housing enclosing the terminals therein, and having two downward extending mounting legs configured to be inserted into a hole on a surface mount technology (SMT) circuit board and at least one side block disposed on either side of the legs in which the thickness of the block is substantially the same as that of the terminals so that the bottom position of the block is substantially flush with that of the terminals, the terminals expose from the rear bottom of the housing each including a vertical portion extending from the rear bottom of the housing and a horizontal portion bending from the vertical portion toward a rear of the housing;

the shielding shell having an upper plane piece, two front side plane pieces, two middle side plane pieces, two rear side plane piece, two pairs of projecting members downward extending from the lower edge of each middle side plane pieces and each rear side plane pieces so as to have the bottom portion of the terminal seat to be exposed to the bottom of the shielding shell, two engaging portions extending from each of said front side plane pieces, respectively, the engaging portions interlocking with each other tightly when the shielding shell encloses a terminal seat, wherein the shielding shell has a bent flange on each of an appropriate position of two lower edges of the engaging portions, the bent flanges together form a flange portion on the engaging portion, and the flange portion is configured to be fastened in a hole of the SMT circuit board of SMT type.

2. The shielding shell structure for an electrical connector of claim 1, wherein said flange portion is configured to be stabley connected to the circuit board by soldering.

3. An electrical connector having a shielding shell and a terminal seat, the terminal seat comprising a housing and terminals, the housing enclosing the terminals therein, and having two downward extending mounting legs configured to be inserted into a hole on a surface mount technology (SMT) circuit board and at least one side block disposed on either side of the legs in which the thickness of the block is substantially the same as that of the terminals so that the bottom position of the block is substantially flush with that of the terminals, the terminals being exposed from the rear bottom of the housing each including a vertical portion extending from the rear bottom of the housing and a horizontal portion bending from the vertical portion toward a rear of the housing;

the shielding shell having an upper plane piece and two side plane pieces, two middle side plane pieces, two rear side plane piece, two pairs of projecting members downward extending from the lower edge of each middle side plane pieces and each rear side plane pieces so as to have the bottom portion of the terminal seat exposed to the bottom of the shielding shell, two engaging portions extending from each of the side plane pieces, respectively, the engaging portions interlocking with each other tightly when the shielding shell encloses a terminal seat, wherein the shielding shell has a bent flange on each of an appropriate position of two lower edges of the engaging portion, the bent flanges each has a protrusion on an appropriate position thereof, the flanges together form a flange portion on the engaging portion, the flange portion is configured to be fastened in a hole of the SMT circuit board, and clasp the protrusions together in the hole.

* * * * *